US010252558B2

(12) United States Patent
Kohlmann et al.

(10) Patent No.: US 10,252,558 B2
(45) Date of Patent: Apr. 9, 2019

(54) METHOD FOR OPERATING A UV CURING DEVICE IN A PRINTING MACHINE

(71) Applicant: HEIDELBERGER DRUCKMASCHINEN AG, Heidelberg (DE)

(72) Inventors: Michael Kohlmann, Frankenthal (DE); Oliver Gottschalt, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/806,577

(22) Filed: Nov. 8, 2017

(65) Prior Publication Data

US 2018/0126766 A1 May 10, 2018

(30) Foreign Application Priority Data

Nov. 8, 2016 (DE) ..... 10 2016 221 855

(51) Int. Cl.
*B41M 7/00* (2006.01)
*B41F 23/04* (2006.01)

(52) U.S. Cl.
CPC ..... *B41M 7/0081* (2013.01); *B41F 23/0409* (2013.01)

(58) Field of Classification Search
None
See application file for complete search history.

(56) References Cited

U.S. PATENT DOCUMENTS 4,760,790 A 8/1988 Birkett
6,857,368 B2 2/2005 Pitz
9,281,093 B2 3/2016 Lott et al.
2007/0251403 A1 11/2007 St. John
2012/0128890 A1 5/2012 Mirchev

FOREIGN PATENT DOCUMENTS

EP 1302735 B1 1/2014
EP 2907527 A1 8/2015
JP 2006181805 A * 7/2006

OTHER PUBLICATIONS

Machine Translation of "Inkjet Recording Device" (JP 2006181805A), Yokoyama, Takeshi et al., Jul. 13, 2006, Paragraphs 0040, 0045, 0067-0070, 0074, 0077-0080.*
Ip.com search.*

* cited by examiner

*Primary Examiner* — Lisa M Solomon
(74) *Attorney, Agent, or Firm* — Laurence A. Greenberg; Werner H. Sterner; Ralph E. Locher

(57) ABSTRACT

A method for operating a UV curing device in a printing machine includes providing a printing material to which a UV-curing fluid or UV printing ink or varnish is applied. The printing material is paper or foil moving in a transport direction and having a width. The fluid is cured by UV radiation emitted by a fluid-cooled first UV LED emitter of the device at least in an effective range thereof. The first UV LED emitter is operated in a curing mode and at a first power, and a fluid-cooled second UV LED emitter is operated in a temperature control mode different than the curing mode and at a second power lower than the first power and different than zero. The second power and the temperature of an LED array of the second UV LED emitter is selected to cause the LED array to be free from condensate.

13 Claims, 3 Drawing Sheets

METHOD FOR OPERATING A UV CURING DEVICE IN A PRINTING MACHINE

CROSS-REFERENCE TO RELATED APPLICATION

This application claims the benefit, under 35 U.S.C. § 119, of German Patent Application DE 10 2016 221 855.7, filed Nov. 8, 2016; the prior application is herewith incorporated by reference in its entirety.

BACKGROUND OF THE INVENTION

Field of the Invention

The present invention relates to a method for operating a UV curing device in a printing machine, in which a UV-curing fluid has been applied to a printing material that is moved in a direction of transport and has a printing material width, and the fluid is cured by UV radiation emitted by at least one fluid-cooled first UV LED emitter of the device at least in the effective range thereof.

The technical field of the invention is the field of curing printing fluids on substrates, in particular polymerizable printing ink or varnish on paper, cardboard, or plastic foil. Curing is achieved by applying electromagnetic radiation, in particular ultraviolet (UV) radiation, to the applied fluid. In that process, the fluid, at least its polymerizable portion, is polymerized.

The curing may be done over the entire surface or in sections. If the format of the substrate has a small width, curing over the entire surface results in unnecessarily high energy consumption. In addition, the radiation may be scattered outside the format width in an undesired way. European Patent EP 1 302 735 B1, corresponding to U.S. Pat. No. 6,857,368, discloses irradiation in accordance with the printed image. However, that document relies on infrared radiation to cure the printing fluid, i.e. heat is applied to the printing fluid, resulting in solvent evaporation. The document does not deal with cooling the device that is used for curing or the components thereof.

The curing process may be temporarily interrupted. European Patent Application EP 2 907 527 A1, corresponding to U.S. Pat. No. 9,281,093, discloses a UV emitter, for instance for curing varnish, adhesives, or plastics. In order to avoid damage to the substrate, the emitter may be switched off when the manufacturing process is interrupted. In order to be able to quickly restart the emitter after such an interruption, the temperature of the emitter is controlled during the interruption by using a heating element. In addition, the document describes cooling the emitter by air.

Known UV LED emitters for curing printing fluids include a plurality of modules that may individually be actuated and are jointly fluid-cooled. During operation of such a device, it may be necessary to switch some modules off. For instance, when smaller-format substrates are printed on, modules on the sides, i.e. outside the printing material, are switched off. Since such modules that have been switched off continue to be fluid-cooled together with the modules that are still in operation, water, e.g. moisture from the ambient air, may condense on the cooled modules. If such modules are restarted at a later time, there may be another problem: the modules may have an insufficient curing effect or may even be damaged.

SUMMARY OF THE INVENTION

It is accordingly an object of the invention to provide a method for operating a UV curing device in a printing machine, which overcomes the hereinafore-mentioned disadvantages of the heretofore-known methods of this general type and which allows individual UV LED emitters in a UV curing device to be operated in a non-curing mode to avoid condensation-related problems.

With the foregoing and other objects in view there is provided, in accordance with the invention, a method for operating a UV curing device in a printing machine, in which a UV-curing fluid has been applied to a printing material that is moved in a direction of transport and has a printing material width, and the fluid is cured by UV radiation emitted by at least one fluid-cooled first UV LED emitter of the device at least in the effective range thereof. The first UV LED emitter is operated in a curing mode at a first power and at least one fluid-cooled second UV LED emitter is operated in a temperature control mode different from the curing mode and at a second power lower than the first power and different from zero. The second power and consequently the temperature of at least one LED array of the second UV LED emitter is selected in such a way that the LED array is free from condensate.

In accordance with the invention, undesired or even damaging water condensation, e.g. from the ambient air, may be prevented by operating the device in a temperature-control mode, allowing the UV curing process to be carried out in an unimpeded and thus advantageous way. Although it may initially seem contradictory, the second UV LED emitter is thus cooled (with a liquid) while at the same time its temperature is controlled (electrically), in particular, the second UV LED emitter is warmed up or heated.

The method of the invention may be used in production machinery and coating lines in general, in particular in lithographic offset printing presses (UV printing inks and varnishes) and in inkjet printing machines (UV inks and varnishes).

Another preferred development of the invention is distinguished in that the temperature of at least one LED array of the cooled second UV LED emitter is above the dew point temperature.

A further preferred development of the invention may be distinguished in that the first UV LED emitter is disposed in a first position in a transverse direction perpendicular to the direction of transport and parallel to the direction of the printing material width and the second UV LED emitter is disposed in the transverse direction in a second position different from the first position.

An added preferred development of the invention may be distinguished in that the first position is inside the format region corresponding to the printing material width and the second position is outside the format region.

An additional preferred development of the invention may be distinguished in that the first position is inside an image area corresponding to the printed area on the printing material and the second position is outside the image area.

Another preferred development of the invention may be distinguished in that the device is operated with a first group of at least two first UV LED emitters and a second group of at least two second UV LED emitters and in that the decision as to which LEDs of the device are to be assigned to the first group and which LEDs of the device are to be assigned to the second group is made as a function of the format region.

A further preferred development of the invention may be distinguished in that the cooling power is the same in the curing mode and in the temperature control mode.

An added preferred development of the invention may be distinguished in that the second output is selected as a function of the cooling power.

An additional preferred development of the invention may be distinguished in that the first UV LED emitter and the second UV LED emitter are jointly cooled, i.e. are connected to the same coolant circuit. A separate cooling device (including additional control valves) for the individual emitters may advantageously be dispensed with. Alternatively, it is possible for the first UV LED emitter and the second UV LED emitter to be cooled separately, in particular to be connected to a coolant circuit by using respective individually controllable valves.

Another preferred development of the invention may be distinguished in that the second power ranges between 5% and 30%, preferably between 10% and 20%, of the first power.

A concomitant preferred development of the invention may be distinguished in that at least one further fluid-cooled UV LED emitter is operated in a temperature control mode different from the curing mode and at a second power that is lower than the first power and different from zero. The further UV LED emitter may be offset from the first and/or second UV LED emitter/s, e.g. in the direction of transport and/or perpendicular to the direction of transport.

The invention and the preferred further developments thereof will be described in more detail below with reference to the drawings and based on a preferred exemplary embodiment. For reasons of clarity, mutually corresponding elements in the drawings bear the same reference symbols and reference symbols that are merely repetitive have in part been omitted.

Other features which are considered as characteristic for the invention are set forth in the appended claims.

Although the invention is illustrated and described herein as embodied in a method for operating a UV curing device in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
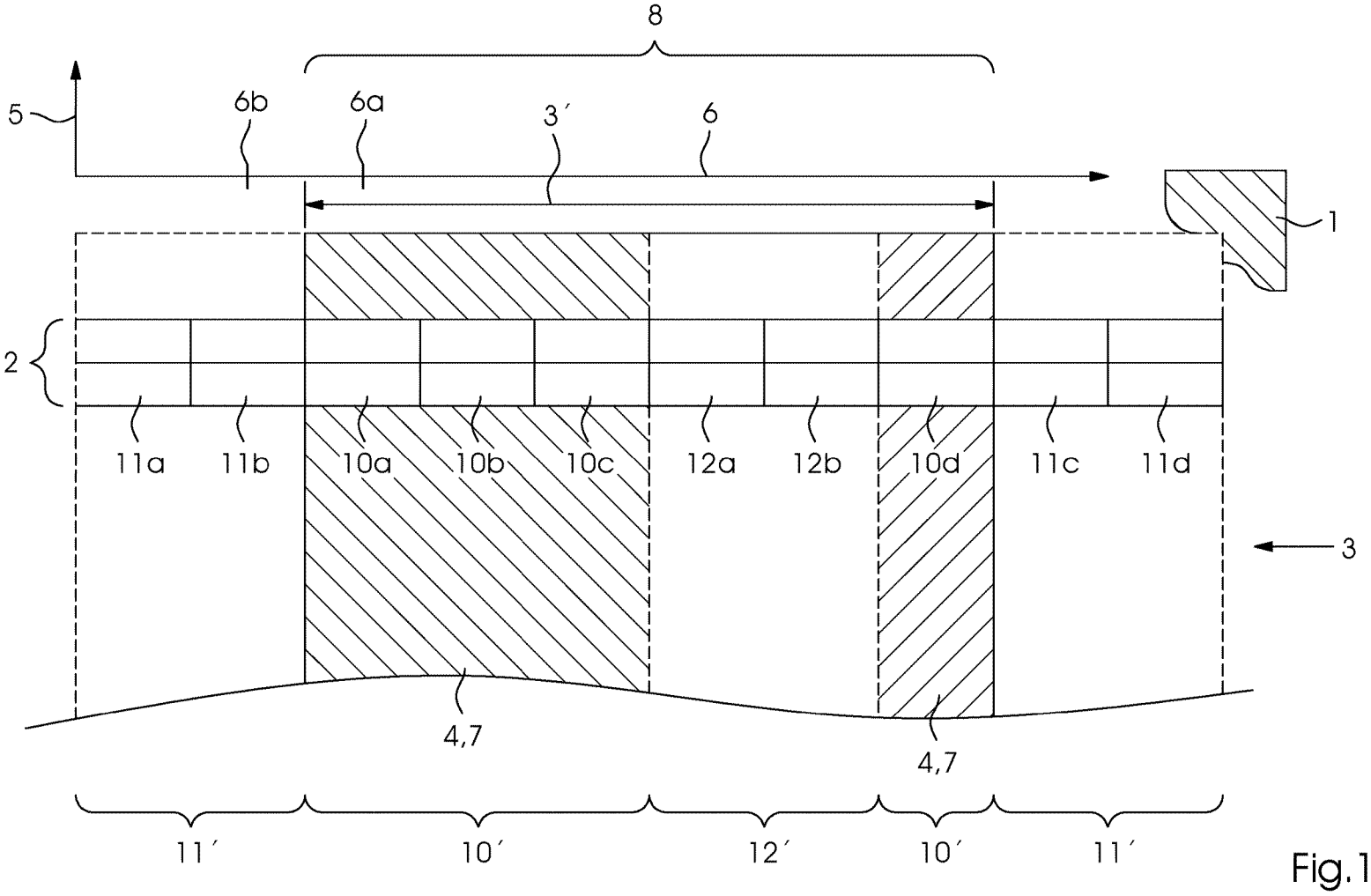
FIG. 1 is a fragmentary, diagrammatic, partially-sectional, top-plan view of a curing device and a substrate.

Referring now to the figures of the drawings in detail and first, particularly, to FIG. 1 thereof, there is seen a section of a printing machine 1 including a curing device 2. The curing device is used to cure a printing material or substrate 3 having a printing material width 3'. A fluid 4 has been applied at least to parts of the printing material, preferably in accordance with a print image. The fluid is a UV cured fluid such UV printing ink or UV varnish. The printing material is moved through the printing machine in a direction of transport 5. A direction referred to as a transverse direction 6 extends in a direction perpendicular to the direction of transport 5 and parallel to the direction of the printing material width 3'. The printing material has a format region 8, which corresponds to the printing material width 3'. The printing material further includes an image area 7, which corresponds to the regions or zones (extending in the direction of transport) to which fluid has been applied. The printing machine has a minimum and a maximum printable format region. An average format range is shown.

The UV curing device 2 includes a number of UV LED emitters. The emitters are disposed next to one another, covering at least the format region 8, preferably the entire width of the printing machine or the maximum format region. The curing device is disposed to be substantially parallel to the transverse direction. The curing device includes first UV LED emitters 10*a* to 10*d* (emitter 10*a* in position 6*a*) having a configuration which corresponds to the image area 7 (or, conversely, emitters that correspond to the image area are referred to as first emitters). The curing device further includes second UV LED emitters 11*a* to 11*d* (emitter 11*b* in position 6*b*), which are disposed outside the format region. Finally, the curing device includes further second UV LED emitters 12*a* and 12*b*, which are outside the image area but inside the format region 8. In the illustrated example, the first UV LED emitters 10*a* to 10*d* are active and the second UV LED emitters 11*a* to 11*d* and 12*a* and 12*b* are practically inactive, i.e. substantially not in a curing mode. Thus, the only UV LED emitters that are actively curing the fluid 4 on the printing material are the first UV LED emitters 10*a* to 10*d*. In other words, the first UV LED emitters 10*a* to 10*d* are operated in a curing mode M1, whereas the further UV LED emitters are not operated in a curing mode. In accordance with the invention, they are instead operated at a temperature control mode M2 that is different from the curing mode. If the format of the substrate and/or the print job (and consequently the image) changes, a first LED may become a second LED and vice versa.

The UV LED emitters 10*a* to 10*d* that are operated in a curing mode M1 form an active first group 10' operated in a curing mode and the UV LED emitters 11*a* to 11*d* and 12*a* and 12*b* that are operated in a temperature control mode M2 form a virtually inactive second group 11' and 12'. When a print job requires maximum format sheets and the image extends over the entire format width, all emitters may be active, i.e. in the curing mode M1. If the print job is different from such a job, at least one emitter will be practically inactive, i.e. in the temperature control mode M2. For smaller formats than the maximum format, these are the emitters in the marginal regions of the device 2.

The curing device 2 may include more than the illustrated UV LED emitters, for instance more than 20. The first and second groups 10', 11' and 12' of such a curing device may include any desired number of UV LED and may extend over any desired width of the curing device. That is to say that the curing device construction shown in FIG. 1 is only to be viewed as a single example.

Figure 2:
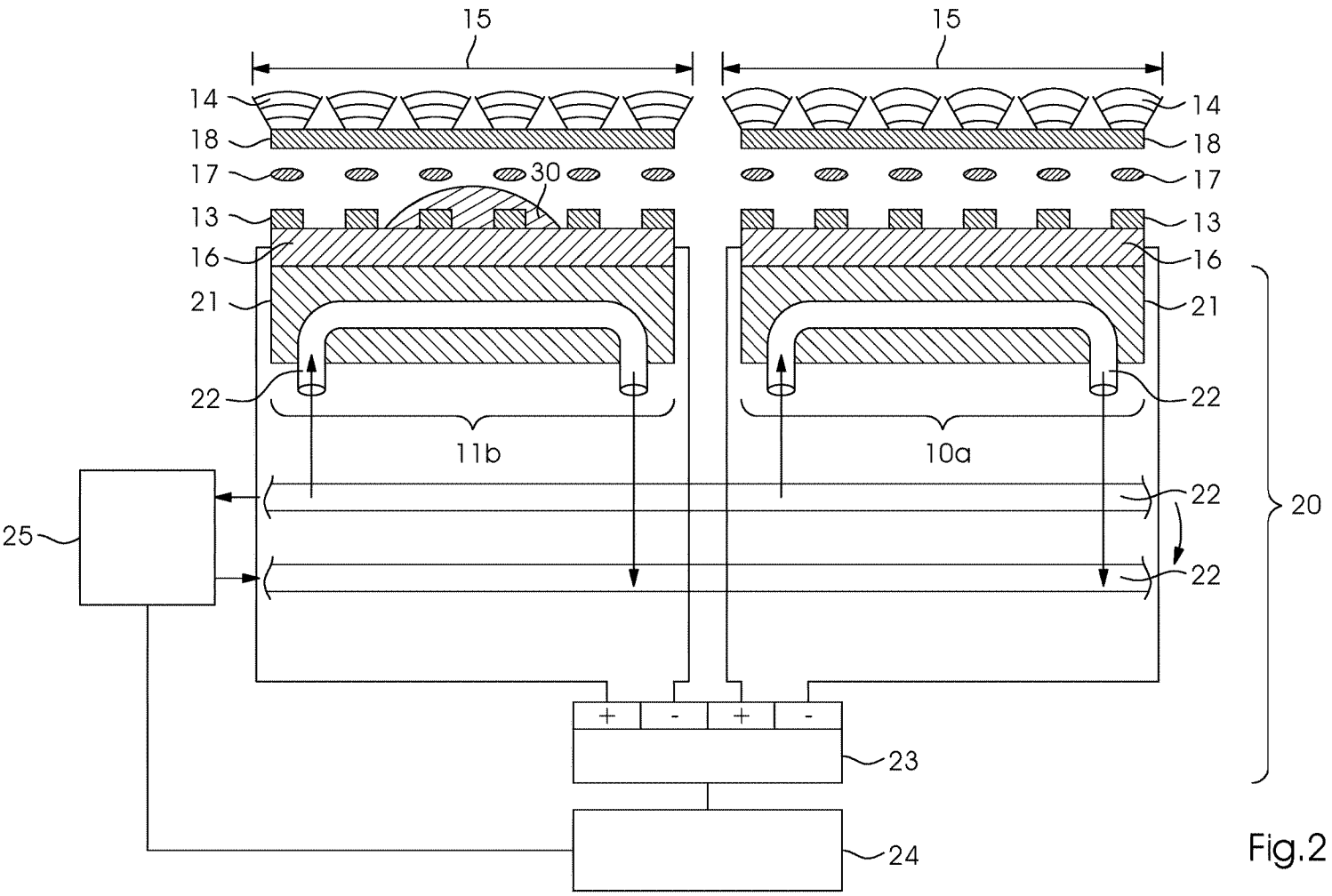
FIG. 2 is a partially-sectional, side-elevational view of a curing device.

For reasons of clarity, the side view of the curing device shown in FIG. 2 is limited to two UV LED emitters 10*a* and 11*b*, of which the emitter 10*a* will be described below by way of example. The illustrated emitter 10*a* includes an LED array or LED line 13 for generating UV radiation 14. In a different example, an LED array may alternatively include only a single LED. The UV radiation generated by the LED array defines an effective range 15 of the UV LED emitter. The UV LED emitter has a board 16 including the respective LED array. The UV LED emitter likewise includes a number of optical lenses 17 that are disposed in front of the LED array and shape the UV radiation. A UV-transparent cover 18, e.g. made of glass, is disposed in front of the lenses. The UV radiation of every UV LED of the respective LED array passes through a respective lens and the cover to reach the substrate 3 in an effective range.

Each one of the two UV LED emitters 10*a* and 11 *b* is fluid-cooled. For this purpose, a fluid-type cooling device 20 is provided. The boards 16 are disposed on cooling bodies 21 that are connected to a coolant circuit 22. Unlike the illustrated construction, the boards may be disposed on a common cooling body. A control device 25 controls the cooling power of the coolant circuit 22, e.g. through the through-put of coolant per unit of time. FIG. 2 shows that the two cooling bodies in the coolant circuit are connected in parallel. In the illustrated example, the two cooling bodies may only be jointly cooled. However, individually controllable valves may be provided in the circuit to allow every coolant body 21 to be cooled individually, for instance between 0% and 100%.

A control device 23 supplies power to the boards 16. The control device may actuate every board individually. In accordance with the invention, the first UV LED emitter 10*a* is operated in a curing mode M1. For this purpose, it is operated at a (relatively) higher (curing) power by the control device. The second UV LED emitter 11*b* is operated in a temperature control mode M2 and is therefore operated at a (relatively) lower power different from zero by the control device. in accordance with the invention, the second UV LED emitter, which is virtually inactive, i.e. is not used for curing in a current print job, is not operated at zero electric power but at a power (above zero but below the curing power) corresponding to the temperature control mode M2. This power ensures that the second UV LED emitter has a temperature and is in particular heated to substantially prevent condensation, in particular of air moisture, on the components thereof, in particular on the LED array 13, lenses 17, or cover 18 thereof.

A computer 24, which may, for instance, be provided on a control panel of a printing machine 1, is connected to the two control devices 23 and 25 for electric control or actuation of the cooling device. The computer may ensure that a temperature control power sufficient to avoid condensation is set at a given cooling power. The computer may also be connected to a (non-illustrated) sensor for measuring air moisture and may take the corresponding measurements thereof into consideration when adjusting the device.

Figure 3:
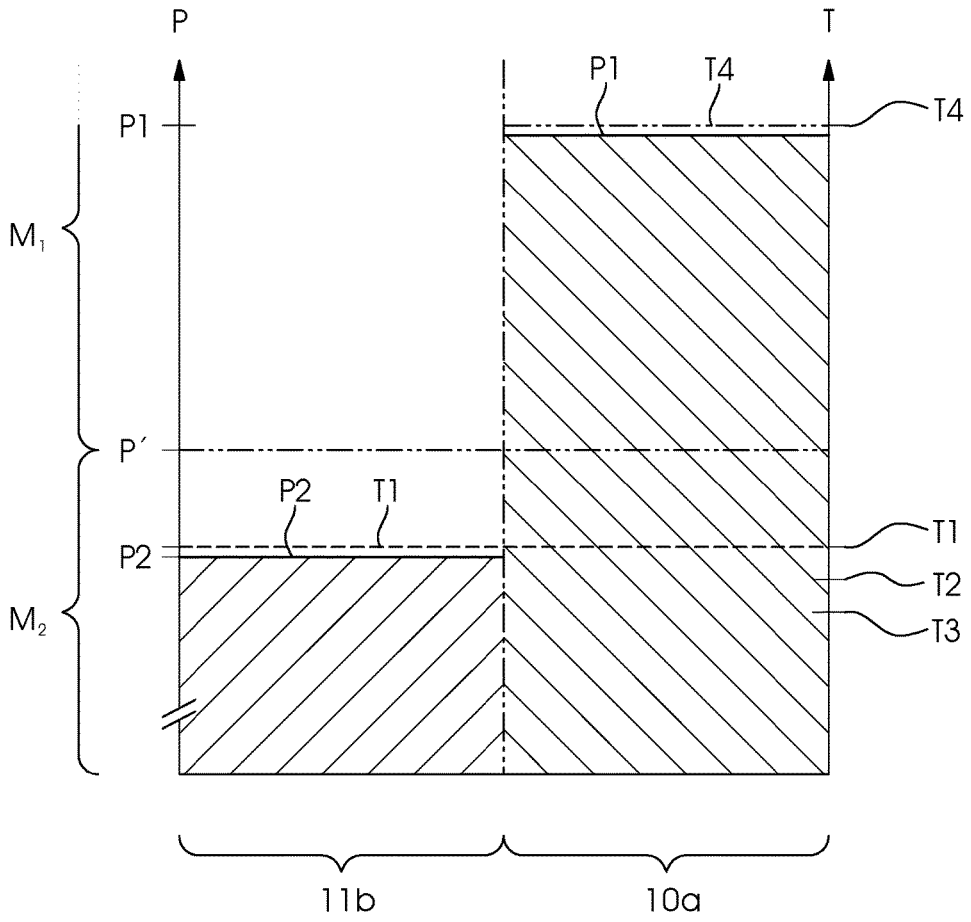
FIG. 3 is a diagram indicating a curing mode and a temperature-control mode.

The diagram shown in FIG. 3 illustrates both the curing mode M1 and the temperature control mode M2. As shown, the first UV LED emitter 10*a* is operated at a first curing power P1. It is also shown that the second UV LED emitter 11*b* is operated at a second (temperature control) power P2, which is lower than the first power. A power threshold P', which is between the two powers P1 and P2, forms the threshold between the curing mode M1 and the temperature control mode M2. The first power P1 is above the power threshold and the second power P2 is below the power threshold.

FIG. 3 further indicates temperatures. A temperature T1 corresponds to the temperature of the (second) LED array of the temperature-controlled second UV LED emitter 11*b*. A temperature T2 corresponds to the dew point temperature of the LED array and a temperature T3 corresponds to a cooling temperature of the fluid-type cooling device 20. The temperature T1 of the second UV LED emitter 11*b* is above the dew point temperature T2. In accordance with the invention, the second UV LED emitter 11*b*, which is virtually inactive, is supplied with (electric) power P2 to heat it to a temperature T1 above the dew point temperature to prevent the second UV LED emitter from cooling down to a temperature T3 below the dew point temperature T2, avoiding undesired condensation or condensed moisture 30. The temperature T4 of the first UV LED emitter 10*a* or rather of the associated (first) LED array 13 is above T1.

The invention claimed is:

1. A method for operating a UV curing device in a printing machine, the method comprising the following steps:

providing a printing material being moved in a direction of transport and having an applied UV-curing fluid and a printing material width;

curing the fluid by UV radiation emitted at least in an effective range of at least one fluid-cooled first UV LED emitter of the device;

operating the at least one fluid-cooled first UV LED emitter in a curing mode at a first power;

operating at least one fluid-cooled second UV LED emitter in a temperature control mode different than the curing mode and at a second power lower than the first power and different from zero;

selecting the second power and consequently the temperature of at least one LED array of the at least one fluid-cooled second UV LED emitter to cause the LED array to be free from condensate; and selecting the temperature of at least the LED array of the at least one fluid-cooled second UV LED emitter to be above a dew point temperature.

2. A method for operating a UV curing device in a printing machine, the method comprising the following steps:

providing a printing material being moved in a direction of transport and having an applied UV-curing fluid and a printing material width;

curing the fluid by UV radiation emitted at least in an effective range of at least one fluid-cooled first UV LED emitter of the device;

operating the at least one fluid-cooled first UV LED emitter in a curing mode at a first power;

operating at least one fluid-cooled second UV LED emitter in a temperature control mode different than the curing mode and at a second power lower than the first power and different from zero;

selecting the second power and consequently the temperature of at least one LED array of the at least one fluid-cooled second UV LED emitter to cause the LED array to be free from condensate;

placing the at least one fluid-cooled first UV LED emitter in a first position in a transverse direction perpendicular to the direction of transport and parallel to a direction of the printing material width and locating the first position within a format region corresponding to the printing material width; and placing the at least one fluid-cooled second UV LED emitter in the transverse direction in a second position different than the first position and locating the second position outside the format region.

3. The method according to claim 2, which further comprises locating the first position inside an image area corresponding to a printed area on the printing material, and locating the second position outside the image area.

4. A method for operating a UV curing device in a printing machine, the method comprising the following steps:

providing a printing material being moved in a direction of transport and having an applied UV-curing fluid and a printing material width;

curing the fluid by UV radiation emitted at least in an effective range of at least one fluid-cooled first UV LED emitter of the device;

operating the at least one fluid-cooled first UV LED emitter in a curing mode at a first power;

operating at least one fluid-cooled second UV LED emitter in a temperature control mode different than the curing mode and at a second power lower than the first power and different from zero;

selecting the second power and consequently the temperature of at least one LED array of the at least one fluid-cooled second UV LED emitter to cause the LED array to be free from condensate;

operating the device with a first group of at least two of the fluid-cooled first UV LED emitters and a second group of at least two of the fluid-cooled second UV LED emitters; and deciding which LED emitters of the device are assigned to the first group and which LED emitters of the device are assigned to the second group as a function of a size of a format region corresponding to the printing material width.

5. The method according to claim 1, which further comprises applying an identical cooling power in the curing mode and in the temperature control mode.

6. The method according to claim 5, which further comprises selecting the second power as a function of the cooling power.

7. The method according to claim 1, which further comprises cooling the at least one fluid-cooled first UV LED emitter and the at least one fluid-cooled second UV LED emitter together.

8. The method according to claim 7, which further comprises connecting one coolant circuit to the at least one fluid-cooled first UV LED emitter and the at least one fluid-cooled second UV LED emitter.

9. The method according to claim 1, which further comprises cooling the at least one fluid-cooled first UV LED emitter and the at least one fluid-cooled second UV LED emitter separately.

10. The method according to claim 9, which further comprises connecting the at least one fluid-cooled first UV LED emitter and the at least one fluid-cooled second UV LED emitter to a coolant circuit through respective individually controllable valves.

11. The method according to claim 1, which further comprises selecting the second power to be in a range of between 5% and 30% of the first power.

12. The method according to claim 1, which further comprises selecting the second power to be in a range of between 10% and 20% of the first power.

13. The method according to claim 1, which further comprises operating at least one further fluid-cooled UV LED emitter in a temperature control mode different than the curing mode at a second power being lower than the first power and different than zero.

* * * * *